US007512358B2

(12) United States Patent
Tanabe

(10) Patent No.: US 7,512,358 B2
(45) Date of Patent: Mar. 31, 2009

(54) DEVELOPER SUPPLY DEVICE AND DEVELOPER

(75) Inventor: Satoshi Tanabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 237 days.

(21) Appl. No.: 11/600,760

(22) Filed: Nov. 17, 2006

(65) Prior Publication Data

US 2007/0116492 A1 May 24, 2007

(30) Foreign Application Priority Data

Nov. 18, 2005 (JP) ..... 2005-333988

(51) Int. Cl.
*G03G 15/08* (2006.01)

(52) U.S. Cl. ..... 399/103; 399/105

(58) Field of Classification Search ..... 399/102–106
See application file for complete search history.

(56) References Cited

U.S. PATENT DOCUMENTS 5,202,729 A * 4/1993 Miyamoto et al. ..... 399/103
5,946,530 A * 8/1999 Tsuji et al. ..... 399/103
6,884,126 B2 4/2005 Johns et al.

FOREIGN PATENT DOCUMENTS

| | | |
|---|---|---|
| JP | 2001-027845 | 1/2001 |
| JP | 2003-241417 | 8/2003 |
| JP | 2005-140952 | 6/2005 |

* cited by examiner

*Primary Examiner*—Hoang Ngo
(74) *Attorney, Agent, or Firm*—Banner & Witcoff, Ltd

(57) ABSTRACT

A toner leakage restrainer is disposed in an opening formed in a development cartridge case. In the development cartridge, the toner which contains fine particles only in a small amount is accommodated such that fusion bonding of the toner to the lower film is not caused even when ten thousand sheets are printed in succession. In the toner, a ratio of the powder particles having a circle equivalent diameter of 3 to 20 μm and a circularity of 0.98 or more to the entire powder particles is 60% or more based on the number of the particles, and a ratio of the powder particles having a circle equivalent diameter of 3 μm or less to the entire particles is 35% or less based on the number of particles.

19 Claims, 10 Drawing Sheets

DEVELOPER SUPPLY DEVICE AND DEVELOPER

CROSS-REFERENCE TO RELATED APPLICATIONS

This Nonprovisional application claims priority under 35 U.S.C. § 119(a) on Patent Application No. 2005-333988 filed in Japan on Nov. 18, 2005, the entire contents of which are hereby incorporated by reference.

BACKGROUND OF THE INVENTION

1. Field of the Invention

The present invention relates to a developer supply device configured to be capable of supplying a developer to an image forming portion for forming an image with the developer comprised of powder particles by attaching the developer to a surface of an image carrier in the form of arrangement of the image, while moving the surface of the image carrier in a predetermined direction of conveyance. Also, the present invention relates to a developer for use in the same, comprised of powder particles.

2. Description of the Related Art

As this kind of developer supply device, a process cartridge is known as disclosed in, for example, JP-A No. 27845/2001. The process cartridge includes a development roller, a toner accommodating container, a toner thickness control blade, and a toner leakage restrainer.

The development roller is configured to be capable of carrying toner on its peripheral surface. The toner accommodating container accommodates therein the toner as the developer. In the toner accommodating container, is formed an opening, where the development roller is rotatably supported. The toner thickness control blade is disposed so as to be slid (sideswiped) against the peripheral surface of the development roller rotating in a predetermined direction through the opening. This toner thickness control blade is configured to be capable of forming a thin layer of the toner on the peripheral surface of the development roller. The toner leakage restrainer is configured to be capable of restraining (reducing) the leakage of the toner from a clearance between the opening, and the development roller and the toner thickness control blade to the outside of the developer supply device.

The toner leakage restrainer employs a side seal, and a lower film. The side seal is provided to be slid (sideswiped) against both ends of the development roller. The side seal is configured to be capable of restraining (reducing) the leakage of the toner from a clearance between the opening and both ends of the development roller. The lower film is provided to be slid (sideswiped) against the peripheral surface of the development roller at the lower part of the development roller (on the downstream side of the predetermined direction of rotation away from a position opposed to the image forming portion). This lower film is also configured to be capable of restraining (reducing) the leakage of the toner from the clearance between the opening and the lower part of the development roller.

In the conventional developer supply device with the above-mentioned configuration, the development roller has its peripheral surface slid (sideswiped) against the toner thickness control blade, while being rotationally driven in the direction as described above. This forms the toner thin layer on the peripheral surface of the development roller. When the development roller is rotationally driven in the above-mentioned direction, the toner thin layer is fed to the image forming portion. The peripheral surface of the development roller having passed through the image forming portion is slid (sideswiped) against the lower film, and then subjected to a toner thin layer forming operation again within the toner accommodating container.

When the number of forming image reaches a great value (for example, several thousands pieces or more of A4 size sheets) in the known developer supply device with the above-mentioned configuration, a longitudinal streak may occur in the formed image along the feed direction of an image recording medium. In identifying the inside of the developer supply device in the case of occurrence of the longitudinal streak, the toner is fusion bonded to a part of the lower film which is slid (sideswiped) against the peripheral surface of the development roller.

SUMMARY OF THE INVENTION

The present invention has been made to solve the foregoing problem, and it is an object of the present invention to provide a developer supply device and a developer which can provide good image formation even when the number of forming images reaches a great value.

A developer supply device according to the present invention is configured to be capable of supplying a developer to an image forming portion for forming an image with the developer comprised of powder particles by attaching the developer to a surface of an image carrier in a form of arrangement of the image, while moving the surface of the image carrier in a predetermined direction of conveyance. More specifically, the developer supply device includes a developer container, a developer carrier, and a developer leakage restrainer.

The developer container is configured to be capable of accommodating therein the developer. The developer container has an opening which is formed to have a longitudinal direction defined by a width direction perpendicular to the conveyance direction.

The developer carrier is adapted to have a longitudinal direction defined by the width direction, and configured to be capable of carrying the developer on a peripheral surface thereof. The developer carrier is supported by the developer container so as to rotate at the opening in a predetermined rotational direction around an axis parallel to the width direction. Thus, the developer carrier is structured and arranged so as to supply the developer carried on its peripheral surface to the image forming portion at which the image carrier and the developer carrier are facing each other by rotating at the opening as mentioned above.

The developer leakage restrainer is constructed of a thin plate. The developer leakage restrainer is attached to the developer container and arranged at the opening. Furthermore, the developer leakage restrainer is butted against the peripheral surface of the developer carrier at the downstream side of the rotational direction away from the image forming portion over the entire longitudinal direction of the developer carrier.

The developer according to the present invention is comprised of the powder particles and accommodated in the developer container, as described above.

To achieve the foregoing objects, the present invention is characterized by that the developer includes the following characteristics: a cumulative ratio of the powder particles having a circle equivalent diameter of 3 μm or less to the entire particles is 35% or less based on the number of particles. The term "circle equivalent diameter" set forth herein means a diameter of a sphere object having the same projected area as that of the powder particle. That is, in the developer of the present invention, the ratio of the powder particles with a small diameter (fine particles), for example, of 3 μm or less in circle equivalent diameter, to the entire particles is small.

With this configuration, the developer supply device and the developer of the present invention can restrain the fusion bonding of the developer to a butting (sliding or sideswiping) part between the developer leakage restrainer and the developer carrier even if the number of forming images reaches a great value (for example, several thousands pieces or more of A4 size sheets). Thus, the present invention can provide the good image formation even when the number of forming the images reaches a large value.

The developer is preferably comprised of toner having a substantially spherical shape. More specifically, a cumulative ratio of the powder particles having a circle equivalent diameter of 3 to 20 μm and a circularity of 0.98 or more to the entire powder particles of the toner is preferably 60% or more based on the number of the particles. Alternatively, or additionally, the developer may be preferably manufactured by a polymerization method.

The term "circularity" set forth herein means a value obtained by dividing a peripheral length of a circle having the same area as the particle area by a particle perimeter. That is, when the particle perimeter is defined as PP, and the circle equivalent diameter is as CED, the circularity C is determined by the following equation:

$$C=\pi\times CED/PP.$$

With this configuration, the developer supply device and the developer of the present invention allows better image formation even when the number of forming images reaches a great value.

The developer may preferably have particle size distribution that does not exhibit a peak of 6% or more based on the number of particles in the circle equivalent diameter of 3 μm or less.

With this configuration, the developer supply device and the developer of the present invention can effectively restrain the fusion bonding of the developer to a butting (sliding or sideswiping) part between the developer leakage restrainer and the developer carrier even when the number of forming images reaches a great value.

The circle equivalent diameter of the powder particles may preferably be determined by a flow particle image analyzer. This flow particle image analyzer is an analyzer configured to introduce a sample solution containing particles of interest dispersed in a solution, into a transparent flow cell, to take an image of the particles passing through the flow cell, and to process the image, thereby permitting measurement of the shape of the particle.

In the flow particle image analyzer, an image of the shape of each powder particle is photographed, and the image taken is processed individually. Thus, the particle size distribution of the developer can be measured with high accuracy over a wide range of particle sizes from the large particle size (about 15 to 16 μm) to the fine particle size (about 0.6 to 3 μm).

In contrast, in other types of particle size distribution measuring devices (laser diffraction particle size distribution measuring device or the like), detection accuracy of the fine particles of a small volume ratio becomes deteriorated due to an influence of the particles with a relatively large diameter (due to particles whose sizes are around the average particle size of the developer, that is to say, about 6 to 12 μm, and the above-mentioned large particles).

The developer may preferably be a non-magnetic one-component toner. Unlike two-component toner, the non-magnetic one-component toner is subjected to relatively strong friction on the peripheral surface of the development carrier to become charged.

With this configuration, the developer supply device and the developer of the present invention can effectively restrain the fusion bonding of the non-magnetic one-component toner to a butting (sliding or sideswiping) part between the developer leakage restrainer and the developer carrier. Thus, according to the present invention, good image formation can be provided using the non-magnetic one-component toner even when the number of forming images reaches a large value.

The developer leakage restrainer may preferably be made of polyester resin. The polyester resin has a high affinity for styrene-acrylic copolymer or polyester resin, which is a main component of the developer. Thus, the present invention can effectively restrain the fusion bonding of the developer to the butting (sliding or sideswiping) part between the developer leakage restrainer made of the polyester resin and the developer carrier.

The developer may preferably be stored in the developer container in an amount enough to be capable of forming the images on ten thousand sheets or more when forming the image with a reflected density of 1.0 or more at an area which occupies 1% of an area of an A4 size sheet, a letter size sheet, or a legal size sheet.

With this configuration, the developer supply device and the developer of the present invention can effectively restrain the fusion bonding of the developer to the butting (sliding or sideswiping) part between the developer leakage restrainer and the developer carrier until the developer within the developer container is used up, thereby providing good image formation.

DETAILED DESCRIPTION OF THE PREFERRED EMBODIMENTS

Some preferred embodiments of the present invention (which are considered to be the best mode by the applicant at the filing date of the application) will be described with reference to the accompanying drawings.

<Whole Structure of Laser Printer>

Figure 1:
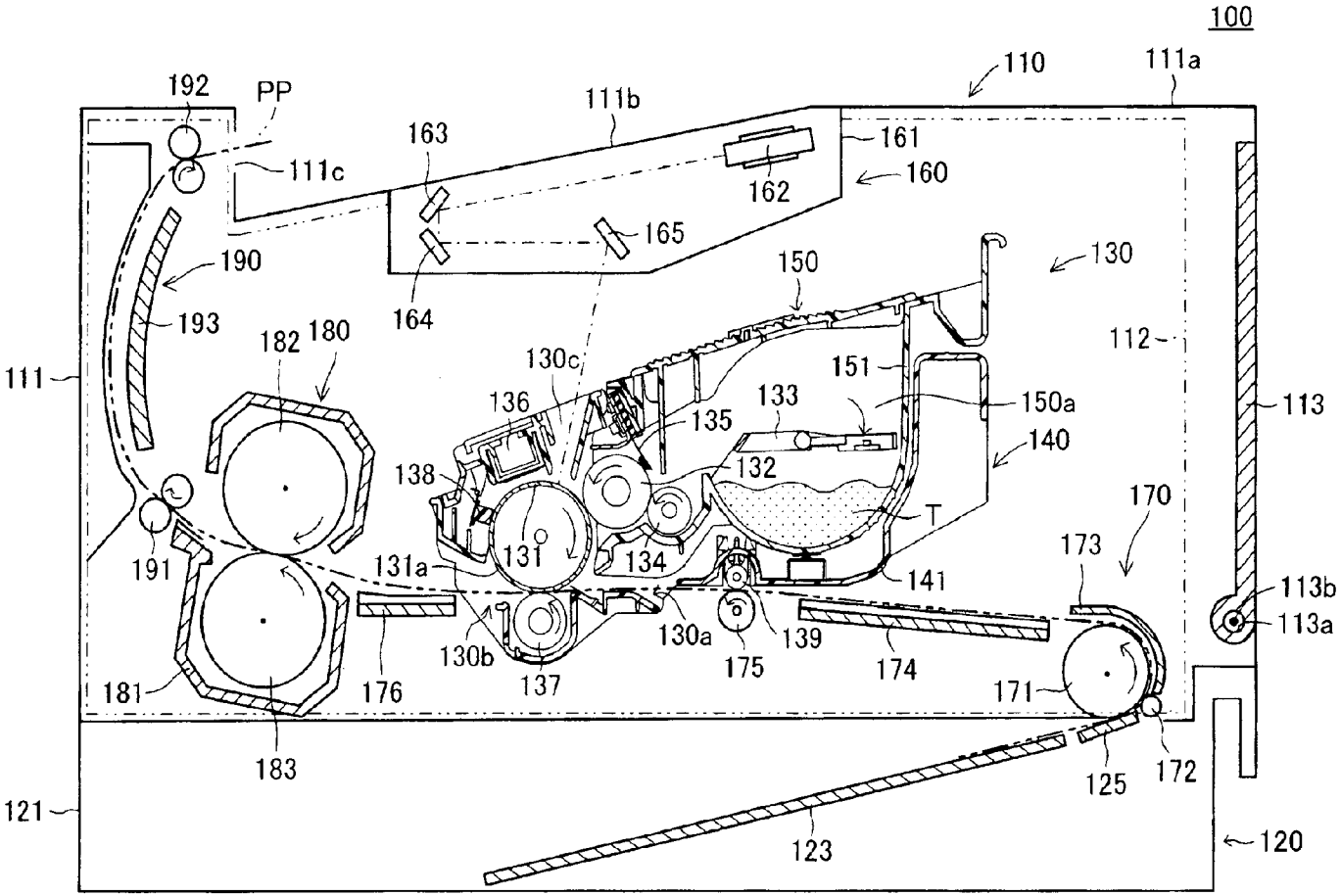
FIG. 1 is a side sectional view showing a schematic structure of a laser printer to which one preferred embodiment of the present invention is applied.

FIG. 1 is a side sectional view showing a schematic structure of a laser printer 100 to which one preferred embodiment of the present invention is applied. A tangential direction of a sheet conveyance path PP in FIG. 1 is defined as a sheet conveyance direction. Furthermore, a direction always perpendicular to the sheet conveyance direction is defined as a sheet width direction of the printer (a direction vertical to the sheet surface of FIG. 1). A direction along the sheet conveyance direction and perpendicular to the sheet width direction is defined as the cross direction of the printer (lateral direction in FIG. 1). One end of the laser printer 100 in the printer cross direction is hereinafter referred to as a "front" side, while the other end thereof is hereinafter referred to as a "back" side. FIG. 1 illustrates a sectional view of the center of the laser printer 100, that is, a sectional view across the center part of the laser printer 100 in the sheet width direction.

The laser printer 100 includes a main body 110, and a feeder unit 120 for feeding a recording medium (sheet) to the main body 110.

A process cartridge 130 for forming an image with toner T (developer) on a sheet of paper is detachably mounted in the main body 110. The process cartridge 130 includes a drum unit 140 for accommodating therein a photoreceptor drum 131 adapted to form an electrostatic latent image, and a development cartridge 150 of a developer supply device of one embodiment, which is configured to be capable of supplying the toner T to the electrostatic latent image.

A drum unit case 141 constituting a casing for the drum unit 140, and a development cartridge case 151 constituting a casing for the development cartridge 150 are detachable from each other. A toner accommodating chamber 150*a* is a space where the toner T is accommodated (stored) within the development cartridge case 151 of the development cartridge 150. The toner T is accommodated in the toner accommodating chamber 150*a* in an amount enough to form images on ten thousand sheets or more when forming an image with a reflected density of 1.0 or more at an area which occupies 1% of an area of an A4 sheet in an initial state.

A scanner unit 160 is disposed above the process cartridge 130 within the main body 110. The scanner unit 160 is configured to irradiate a peripheral surface 131*a* of the photoconductive drum 131 provided in the drum unit 140, with a laser beam modulated according to the image data, thereby enabling formation of the electrostatic latent image on the peripheral surface 131*a*.

Within the main body 110, a sheet feeder 170, a fixing unit 180, and a sheet ejector 190 are disposed. The sheet feeder 170 is configured to be capable of feeding a paper sheet stored in the feeder unit 120 toward the process cartridge 130. The fixing unit 180 is configured to be capable of fixing the image formed of toner T by the process cartridge 130 onto the sheet. The sheet ejector 190 is configured to eject the sheet having passed through the fixing unit 180 toward the outside of the laser printer 100.

Now, the structure of each component included in the above-mentioned laser printer 110 will be described in detail.

<<Structure of Casing of Main Body>>

An outer cover 111 is a member having a substantially rectangular parallelepiped shape and constituting the casing of the main body 110, and is integrally formed of a synthetic resin plate. The outer cover 111 is provided to cover a main body frame 112 for supporting each of various components accommodated in the main body 110. A catch tray 111*b* is formed on an upper surface 111*a* of the outer cover 111. The catch tray 111*b* has a slanted surface formed to extend downward with a slope from the front side of the upper surface 111*a* to the back side thereof. That is, the catch tray 111*b* is made of a recess on the upper surface 111*a*. A sheet ejection port 111*c* constructed of an opening is formed at an upper part of the outer cover 111, and above the lower end of the catch tray 111*b*. The catch tray 111*b* is configured to be capable of receiving the sheet ejected from the sheet ejection port 111*c*.

The outer cover 111 has an opening formed on its front side, and a plate-like front cover 113 is attached to cover the opening. On the lower end of the front cover 113, a hole 113*a* is formed which serves as a rotation center of the front cover 113. At the opening of the outer cover 111, a pair of front cover supporting pins 113*b* stands up along the sheet width direction. By inserting these front cover supporting pins 113*b* into the opening 113*a* of the front cover 113, the front cover 113 is supported so as to be opened and closed along the sheet conveyance direction around the front cover supporting pins 113*b*.

That is, the laser printer 100 of the embodiment is configured in such a manner that the process cartridge 130 can be detachably attached from the front side of the laser printer 100 by opening the cover 113 toward the front side.

<<Structure of Feeder Unit>>

The feeder case 121 is a box-shaped member having an opening at its upper part and constituting the casing of the feeder unit 120. The feeder case 121 is configured to be capable of accommodating therein a number of paper sheets of a maximum size of A4 (width 210 mm×length 297 mm) in a laminated state.

In the feeder case 121, a sheet pushing plate 123 and a separation pad 125 are disposed.

The end of the back side (farther side from the separation pad 125 in FIG. 1) of the sheet pushing plate 123 is rotatably supported by the feeder case 121. That is, the sheet pushing plate 123 is supported by the feeder case 121 such that the end of the front side (nearer side to the separation pad 125 in FIG. 1) of the plate can be swung in a substantially vertical direction with the above-described end of the back side being centered. The end of the front side of the sheet pushing plate 123 is urged upward by a spring not shown.

The separation pad 125 is disposed in the vicinity of the end of the front side of the feeder case 121, and on the downstream side of the sheet conveyance direction away from the sheet pushing plate 123. This separation pad 125 is urged upward by a spring not shown. On the upper side surface of the separation pad 125, a separation surface is formed which has a material, such as rubber, with a higher coefficient of friction than that of a paper sheet.

<<Schematic Structure of Process Cartridge>>

At the lower part of the process cartridge 130, a sheet inlet opening 130*a*, and a sheet outlet opening 130*b* are formed. The process cartridge 130 is configured to be capable of arranging and attaching the toner T on the surface of the sheet in the form of image when the paper passes through between the sheet inlet opening 130*a* and the sheet outlet opening 130*b*. That is, the process cartridge 130 is configured to be capable of forming the image with the toner T on the surface of the sheet which passes through between the sheet inlet opening 130*a* and the sheet outlet opening 130*b*.

A laser irradiation opening 130*c* is formed to be opened toward the scanner unit 160 disposed above at the upper part of the process cartridge 130. The laser irradiation opening 130*c* is formed to expose the peripheral surface 131*a* of the photoconductive drum 131 supported in the drum unit 140, toward the scanner unit 160. The laser beam emitted from the scanner unit 160 can be applied to the peripheral surface 131*a* of the photoreceptor drum 131 through the laser irradiation opening 130*c*.

The process cartridge 130 accommodates therein the photoreceptor drum 131, a development roller 132, an agitator 133, a feed roller 134, a toner thickness control blade 135, an electrostatic charger 136, a transfer roller 137, and a drum cleaner 138.

The photoreceptor drum 131 is a cylindrical member with a photosensitive layer formed on its outer peripheral part. The photoreceptor drum 131 is disposed such that the central axis of the cylindrical shape in the longitudinal direction is parallel to the sheet width direction. The photoreceptor drum 131 is supported within the process cartridge 130 (drum unit 140) so as to be rotationally driven in a direction indicated by an arrow shown in FIG. 1 (clockwise).

The development roller 132 is disposed in parallel to the photoreceptor drum 131 so as to be opposed to the drum 131. The development roller 132 has a semiconductive rubber layer formed on its outer periphery of a rotational central axis made of metal. The semiconductive rubber layer is made of synthetic rubber containing carbon black. The development roller 132 is rotatably supported within the process cartridge 130 (development cartridge 150). The development roller 132 with this configuration is rotationally driven in a direction indicated at an arrow in FIG. 1 (counterclockwise), so that the toner T can be supplied to the peripheral surface 131*a* of the photoreceptor drum 131 with the electrostatic latent image formed thereon.

The agitator 133 is disposed in the toner accommodating chamber 150*a*. The agitator 133 is rotatably supported within the accommodating chamber 150*a*. This agitator 133 is rotationally driven along a direction indicated by an arrow shown (clockwise), so that the toner T accommodated in the toner accommodating chamber 150*a* can be stirred. Furthermore, the rotational driving of the agitator 133 as described above allows part of the toner T stirred in the toner accommodating chamber 150*a* to be sent out to the development roller 132.

The feed roller 134 is disposed between the development roller 132 and the agitator 133 so as to be in contact with the development roller 132. The feed roller 134 is constructed by forming a sponge layer around the outer periphery of the metallic rotational central axis. The feed roller 134 is rotatably supported within the process cartridge 130 (development cartridge 150). The feed roller 134 is rotationally driven in a direction as indicated by an arrow shown (counterclockwise: in the same direction as the rotational direction of the development roller 132), so that the toner T set out from the toner accommodating chamber 150*a* is slid against the peripheral surface of the development roller 132 to be carried on the peripheral surface.

The toner layer thickness control blade 135 is structured and arranged in such a manner that the blade can be brought into contact with the peripheral surface of the development roller 132, which carries the toner T thereon by being slid (sideswiped) against the feed roller 134, thereby adjusting the thickness, density, and amount of charge of the toner T carried on the peripheral surface.

The electrostatic charger 136 is disposed to be opposed to the peripheral surface 131*a* of the photoreceptor drum 131. More specifically, the electrostatic charger 136 is disposed so as to be opposed to the peripheral surface 131*a* of the photoreceptor drum 131 on the upstream side of the rotational direction of the photoreceptor drum 131, away from the above-mentioned position for irradiation of the laser beam (the position opposed to the laser irradiation opening 130*c*). The electrostatic charger 136 is a scorotron charger which is configured to uniformly charge the peripheral surface 131*a* of the photoreceptor drum 131 as described above.

The transfer roller 137 is rotatably supported within the process cartridge 130 (drum unit 140). This transfer roller 137 is disposed below the photoreceptor drum 131 to oppose the photoreceptor drum 131 across the sheet conveyance path PP. Between the transfer roller 137 and the peripheral surface 131*a* of the photoreceptor drum 131, is formed a predetermined clearance through which the sheet can pass. That is, the transfer roller 137 is disposed to oppose the peripheral surface 131*a* of the photoreceptor drum 131 on the downstream side of the rotational direction of the photoreceptor drum 131, away from a position opposed to the development roller 132. A high voltage power source is connected to the transfer roller 137. The toner T is subjected to an electrostatic force directed from the peripheral surface 131*a* of the photoreceptor drum 131 to the transfer roller 137 by a voltage applied between the peripheral surface 131*a* of the photoreceptor drum 131 and the transfer roller 137, so that the toner T is transferred to the surface of the paper sheet.

The drum cleaner 138 is structured and arranged to be capable of cleaning the peripheral surface 131*a* of the photoreceptor drum 131 before the drum is charged uniformly by the electrostatic charger 136. More specifically, the drum cleaner 138 is disposed to be in contact with the peripheral surface 131*a* of the photoreceptor drum 131 at a predetermined pressure. The drum cleaner 138 is disposed to oppose the peripheral surface 131*a* of the photoreceptor drum 131 on the upstream side of the rotational direction of the photoreceptor drum 131, away from a position opposed to the electrostatic charger 136. Furthermore, the drum cleaner 138 is disposed to oppose the peripheral surface 131*a* of the photoreceptor drum 131 on the downstream side of the rotational direction of the photoreceptor drum 131, away from a position opposed to the transfer roller 137 across the sheet conveyance path PP.

An upper resist roller 139 for adjusting the orientation and conveyance timing of the sheet is rotatably supported on the upstream side of the sheet conveyance direction away from the sheet inlet opening 130*a* outside the process cartridge 130.

<<Structure of Scanner Unit>>

The scanner unit 160 is disposed above the process cartridge 130, and includes a scanner case 161, a polygon mirror 162, and reflecting mirrors 163, 164, and 165.

A motor not shown which is adapted to be rotationally driven at a predetermined number of revolutions is fixed to the scanner case 161. The polygon mirror 162 is attached to the rotational driving shaft of the motor. The polygon mirror 162 is configured to reflect a laser beam generated based on image data by a laser emitting part not shown, while being rotationally driven by the motor, thereby enabling the scanning with the laser beam in the sheet width direction. The reflecting mirrors 163, 164, and 165 are supported within the scanner case 161 such that the laser beam reflected by the polygon mirror 162 (shown by a dashed-dotted line in the figure) can be applied to the peripheral surface 131*a* of the photoreceptor drum 131 through the laser irradiation opening 130*c* formed in the process cartridge 130.

<<Structure of Sheet Feeder>>

The sheet feeder 170 includes a sheet feed roller 171, a paper dust removing roller 172, a sheet guide 173 on the outside of the sheet feed roller 171, a sheet guide 174 on the upstream side of the process cartridge 130, a lower resist roller 175, and a sheet guide 176 on the downstream side of the process cartridge 130.

The sheet feed roller 171 is rotatably supported by the main body frame 112 of the main body 110. The sheet feed roller 171 is disposed to oppose the separation pad 125 in such a manner that its peripheral surface is in contact with the separation pad 125 at a predetermined pressure.

The paper dust removing roller 172 is rotatably supported by the main body frame 112 on the front side away from the separation pad 125 (on the downstream side of the rotational direction of the sheet feed roller 171 in feeding). This paper power removing roller 172 is disposed such that its peripheral surface comes into contact with the sheet feed roller 171.

The sheet guide 173 on the outside of the sheet feed roller 171 is disposed to enclose the sheet feed roller 171. This sheet guide 173 is a member to guide the paper sheet in such a manner that one sheet of paper picked up by the sheet feed roller 171 can be delivered or conveyed along the sheet conveyance path PP, while being turned back from the front side toward the back side by the sheet feed roller 171.

The sheet guide 174 on the upstream side of the process cartridge 130 is disposed to be capable of supporting the paper sheet from the below between a downstream end of the sheet conveyance direction of the sheet guide 173 and the above-mentioned upper resist roller 139 disposed on the process cartridge 130. This sheet guide 174 is a member to guide the paper sheet in such a manner that the paper sheet having passed through the sheet feed roller 171 can be delivered or conveyed along the sheet conveyance path PP toward the process cartridge 130.

The lower resist roller 175 is a roller for adjusting the orientation and conveyance timing of the sheet in cooperation with the above-mentioned upper resist roller 139. The lower resist roller 175 is disposed to oppose the upper resist roller 139 across the sheet conveyance path PP. Furthermore, the lower resist roller 175 is disposed on the upstream side of the sheet conveyance direction, away from the position where the photoreceptor drum 131 is opposed to the transfer roller 137.

The sheet guide 176 on the downstream side of the process cartridge 130 is disposed to be capable of supporting the sheet from the below between the sheet outlet opening 131*c* and the fixing unit 180.

<<Structure of Fixing Unit>>

The fixing unit 180 is disposed on the downstream side of the sheet conveyance direction away from the position where the photoreceptor drum 131 is opposed to the transfer roller 137. The fixing unit 180 includes a fixing unit cover 181, a heat roller 182, and a pressing roller 183.

The fixing unit cover 181 is a member which intervenes between the process cartridge 130, and the heat roller 182 and the pressing roller 183 to restrain heating of the process cartridge 130 as much as possible. The heat roller 182 accommodates a halogen lamp in a metallic cylinder whose surface is subjected to an exfoliation treatment, and is rotatably supported within the fixing unit cover 181 so as to be rotationally driven in a direction indicated by an arrow shown (clockwise) by the motor not shown. The pressing roller 183 is a roller made of silicon rubber, and is rotatably supported within the fixing unit cover 181 so as to be pressed against the heat roller 182 at a predetermined pressure, while following the heat roller 182, thereby rotating in a direction indicated by an arrow shown (counterclockwise).

<<Structure of Sheet Ejector>>

The sheet ejector 190 includes sheet conveyance rollers 191, sheet ejection rollers 192, and a sheet guide 193.

The sheet conveyance rollers 191 are formed of a pair of rollers adapted to be rotationally driven by the motor not shown, and are disposed in the vicinity of the outlet of the fixing unit 180. The sheet ejection rollers 192 are formed of a pair of rollers adapted to be rotationally driven by the motor not shown, and are disposed in the vicinity of the sheet ejection port 111*c*. The sheet guide 193 is a member for guiding the sheet from the sheet conveyance rollers 191 to the sheet ejection rollers 192 along the sheet conveyance path PP.

<<Detailed Structure of Process Cartridge>>

Figure 2:
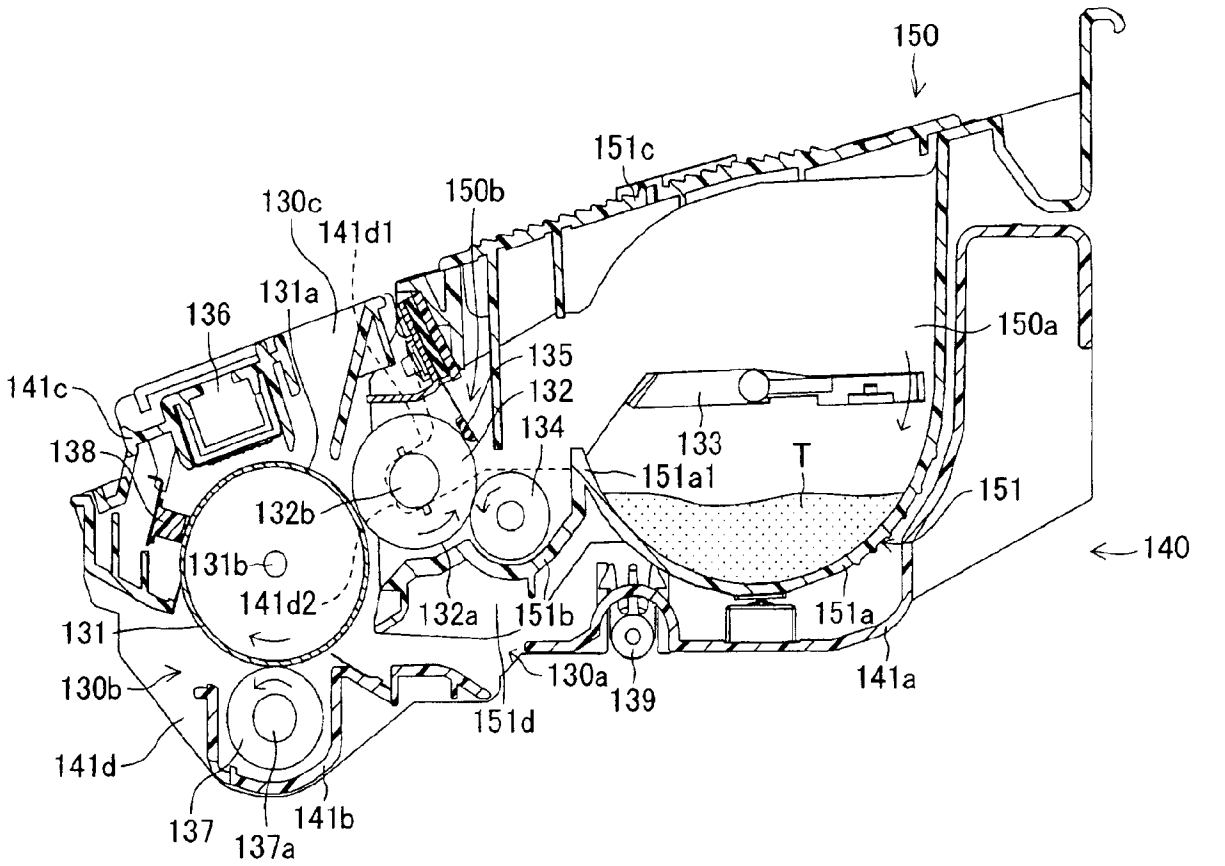
FIG. 2 is an enlarged side sectional view of a process cartridge shown in FIG. 1.
Figure 3:
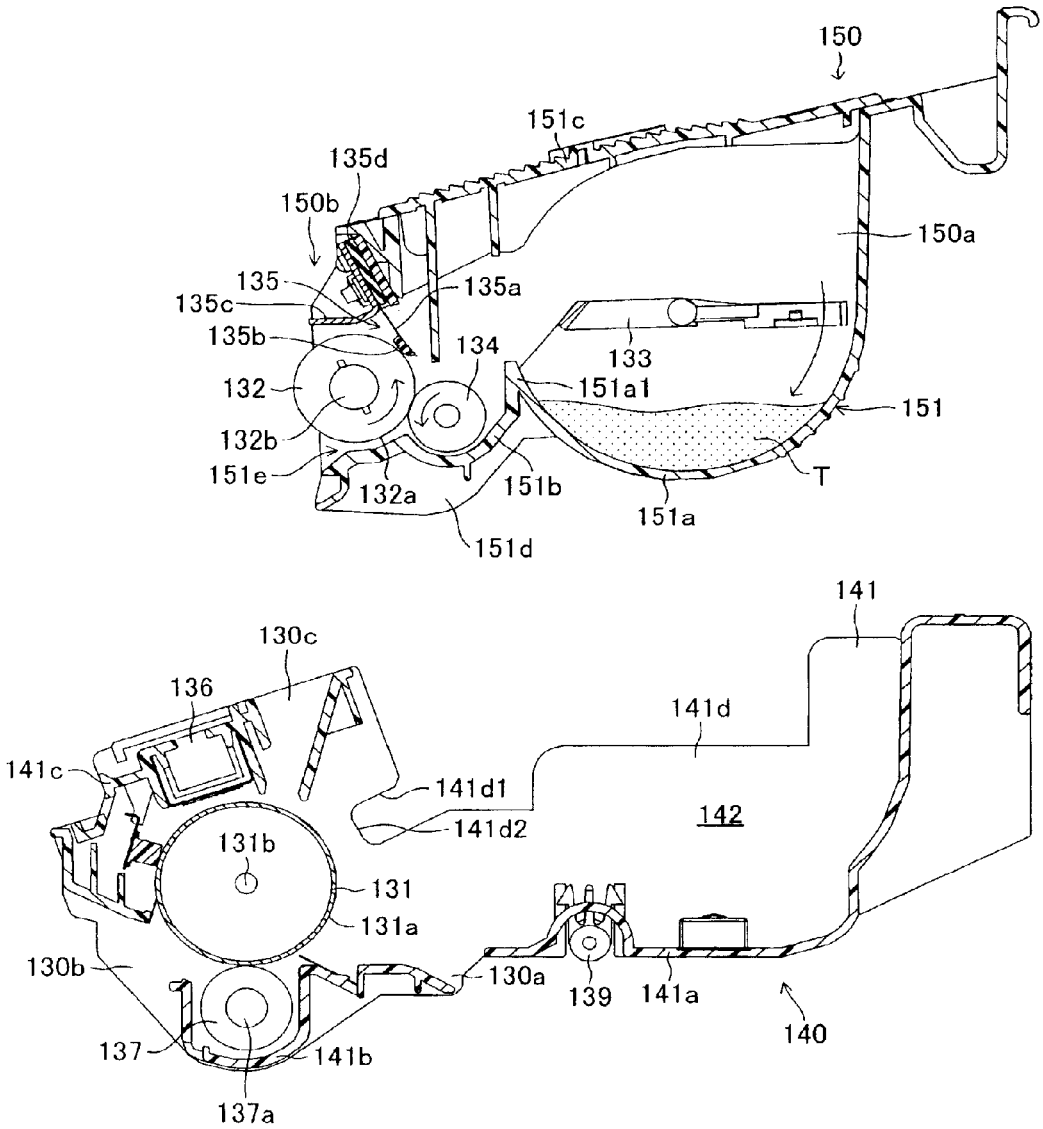
FIG. 3 is a side sectional view showing a state in which a drum unit and a development cartridge shown in FIG. 2 are separated from each other.

FIG. 2 is an enlarged side sectional view of the process cartridge 130 shown in FIG. 1. FIG. 3 is a side sectional view of a state in which the drum unit 140 and the development cartridge 150 shown in FIG. 2 are separated from each other.

In the embodiment, the drum unit 140 includes the photoreceptor drum 131, the electrostatic charger 136, the transfer roller 137, and the drum cleaner 138. The development cartridge 150 further includes the development roller 132, the agitator 133, the supply roller 134, and the toner thickness control blade 135.

In the process cartridge 130, the thin layer of the toner T is formed on the peripheral surface 132*a* of the development roller 132 by rotation of the development roller 132, the agitator 133, and the feed roller 134 in the respective directions indicated by the arrows shown. This toner T thin layer is supplied to the peripheral surface 131*a* of the photoreceptor drum 131, thereby permitting development of the electrostatic latent image formed on the peripheral surface 131*a*. In the following, details of the structure of the process cartridge 130 will be described.

<<Structure of Drum Unit>>

Referring to FIGS. 2 and 3, the drum unit case 141 includes a drum unit case base plate 141*a*, a transfer roller accommodating part 141*b*, an electrostatic charger supporting part 141*c*, and a pair of drum unit case side plates 141*d*.

The upper resist roller 139 is provided under the drum unit case base plate 141*a*. A space enclosed by the drum unit case base plate 141*a* and the pair of the drum unit case side plates 141*d* forms the development cartridge accommodating part 142 in which the development cartridge 150 is accommodated.

The sheet inlet opening 130*a* is formed between one end of the downstream side of the drum unit case base plate 141*a* in the sheet conveyance direction (left end of the plate shown) and one end of the upstream side of the transfer roller accommodating part 141*b* in the sheet conveyance direction (right end of the accommodating part shown).

The transfer roller accommodating part 141*b* is provided to cover the transfer roller 137 from the below. The upstream side part of the transfer roller accommodating part 141*b* in the sheet conveyance direction away from the transfer roller 137 is formed in such a shape that allows the paper sheet to be guided smoothly with respect to the transfer position where the transfer roller 137 is opposed to the photoreceptor drum 131.

The electrostatic charger supporting part 141*c* is a member for supporting the electrostatic charger 136 and the drum cleaner 138. The sheet outlet opening 130*b* is formed between one end of the downstream side of the transfer roller accommodating part 141*b* in the sheet conveyance direction (left end of the accommodating part shown) and the lower end of the electrostatic charger supporting part 141*c*. The laser irradiation opening 130*c* is formed above the electrostatic charger supporting part 141*c*. The laser irradiation opening 130*c* can cause the peripheral surface 131*a* of the photoreceptor drum 131 to be exposed upward as mentioned above.

The pair of drum unit case side plates 141*d* are members to rotatably support the photoreceptor drum 131 and the transfer roller 137. The rotational central axis 131*b* of the photoreceptor drum 131 and the rotational central axis 137*a* of the transfer roller 137 are supported so as to run between the pair of drum unit case side plates 141*d*.

On the drum unit case side plate 141*d*, a positioning opening 141*d*1 is formed to be opened toward the development cartridge 150. The positioning opening 141*d*1 is adapted to position the drum unit 140 (photoreceptor drum 131) and the development cartridge 150 (development roller 132), thereby allowing the peripheral surface 131*a* of the photoreceptor drum 131 to be brought into contact with the peripheral surface 132*a* of the development roller 132 at the predetermined pressure. That is, both ends of the rotational central axis 132*b* of the development roller 132 are inserted into the positioning openings 141*d*1, and then are butted against a positioning end surface 141*d*2, which is the end of the positioning opening 141*d*1. This can position the rotational central axis 131*b* of the photoreceptor drum 131 and the rotational central axis 132*b* of the development roller 132.

<<<Structure of Development Cartridge>>>

Referring to FIG. 3, the development cartridge 151 includes a toner accommodating chamber base plate 151*a*, a toner layer forming part base plate 151*b*, a development cartridge case top plate 151*c*, and a pair of development cartridge case side plates 151*d*.

The toner accommodating chamber base plate 151*a* and the toner layer forming part base plate 151*b* constitute the base plate of the casing of the development cartridge 150. The toner accommodating chamber base plate 151*a* and the toner layer forming part base plate 151*b* are integrally formed with each other by injection molding using synthetic resin.

The toner accommodating chamber base plate 151*a* is a member constituting a base plate for the toner accommodating chamber 150*a* serving as the space in which the toner T is accommodated (stored) within the development cartridge 150. That is, a space enclosed by the toner accommodating chamber base plate 151*a*, the development cartridge case top plate 151*c*, and the pair of development cartridge case side plates 151*d* forms the above-mentioned toner accommodating chamber 150*a*.

The toner layer forming part base plate 151*b* is a member constituting a casing base plate for the toner layer forming part 150*b* which is adapted for forming the toner T layer of predetermined thickness and density on the peripheral surface 132*a* of the development roller 132. That is, the development roller 132, the feed roller 134, and the toner layer thickness control blade 135 are disposed in a space enclosed by the toner layer forming part base plate 151*b*, the development cartridge case top plate 151*c*, and the pair of development cartridge case side plates 151*d*, thereby forming the toner layer forming part 150*b*.

A development roller accommodating opening 151*e* is formed by farther edges from the toner accommodating chamber 150*a*, of the toner layer forming part base plate 151*b*, the development cartridge case top plate 151*c*, and the pair of development cartridge case side plates 151*d*. The development roller accommodating opening 151*c* is formed so as to oppose the peripheral surface 131*a* of the photoreceptor drum 131 when the development cartridge 150 is attached to the drum unit 140.

The development roller 132 is disposed such that a substantial half of the peripheral surface 132*a* can be exposed to the outside from the development roller accommodating opening 151*e*. The toner layer thickness control blade 135 is attached to the development cartridge case top plate 151*c* via a plate spring holder 135*c* and a spacer 135*d* in such a manner that a rubber butting part 135*b* attached to the tip of the plate spring 135*a* is butted against the peripheral surface 132*a* of the development roller 132 in a "counter direction". When a direction directed from the basic end of the plate spring 135*a* of the toner layer thickness control blade 135 toward the butting part 135*b* is defined as a "blade arrangement direction", the "counter direction" means a direction of setting the toner layer thickness control blade 135 such that a rotational direction (tangential direction) of the development roller 132 at a contact between the butting part 135*b* and the peripheral surface 132*a* of the development roller 132 is opposite to the above-mentioned blade arrangement direction (that is, an angle between both directions exceeds 90 degrees).

A toner passage barrier wall 151*a*1 is formed between the toner accommodating chamber base plate 151*a* and the toner layer forming part base plate 151*b*. The toner passage barrier wall 151*a*1 is configured to be capable of preventing the total amount of toner T accommodated in the toner accommodating chamber 150*a* from flowing out to the toner layer forming part 150*b*. That is, the toner passage barrier wall 151*a*1 can accommodate the sufficient amount of toner T in the toner accommodating chamber 150*a*, and stands up to a predetermined height such that the toner T can be sent out to the toner layer forming part 150*b* little by little by the rotational driving of the agitator 133.

<<<Structure of Toner Seal at Development Roller Accommodating Opening>>>

Figure 4A:
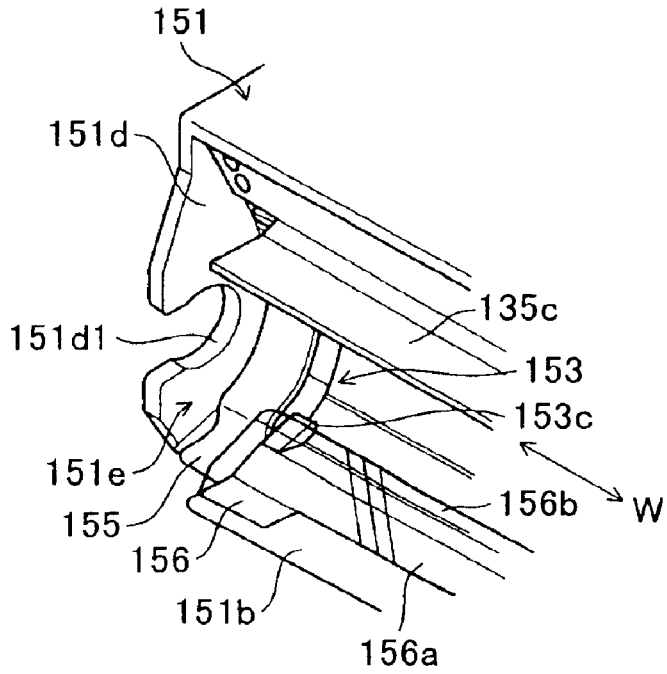
FIG. 4A is a perspective view showing details of a toner seal structure for restraining the leakage of the toner from a development roller accommodating opening shown in FIG. 3.
Figure 4B:
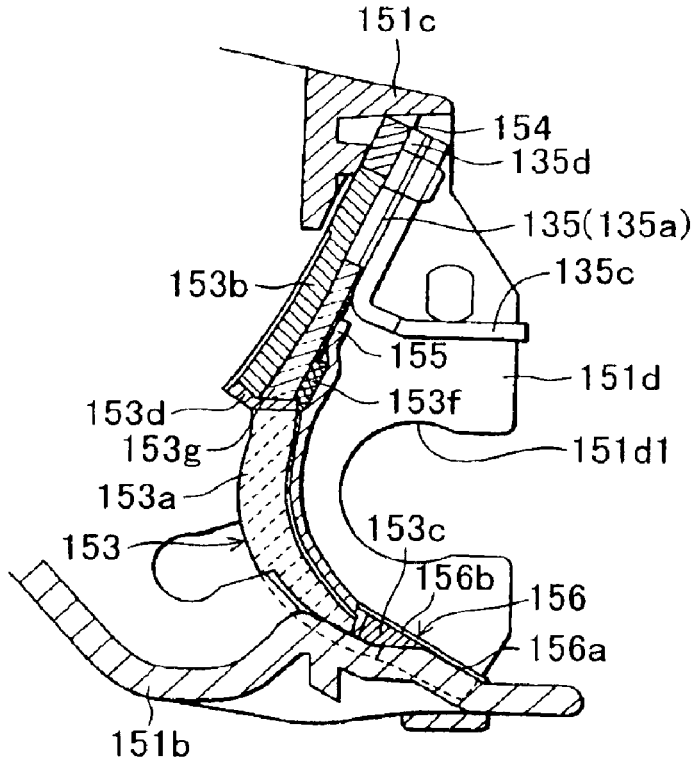
FIG. 4B is a side sectional view thereof.
Figure 5:
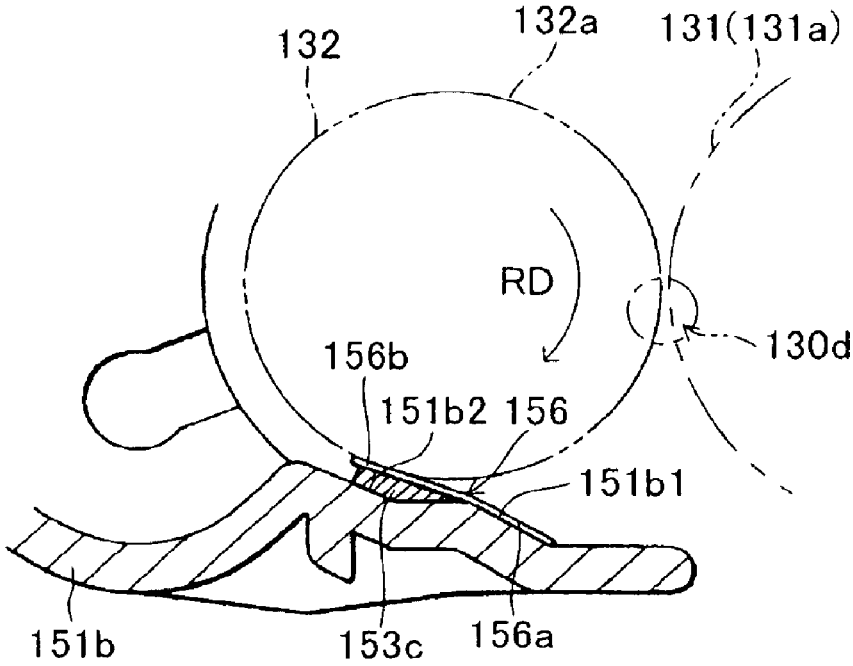
FIG. 5 is an enlarged side sectional view of a main part shown in FIG. 4B.

FIG. 4 shows details of a structure of a toner seal for restraining the leakage of the toner from the development roller accommodating opening 151*e* shown in FIG. 3. FIG. 4A is a perspective view of the structure, and FIG. 4B is a side sectional view thereof. FIG. 5 is an enlarged side sectional view of the main part shown in FIG. 4B.

Referring to FIG. 4A, a side seal 153 is provided at each end of the development roller accommodating opening 151*e* which has a longitudinal direction defined by the sheet width direction indicated by an arrow W shown. More specifically, the side seal 153 is adhered to the development cartridge case side plate 151*d* and the toner layer forming part base plate 151*b* in the vicinity of a hole 151*d*1 for attachment of the development roller 132, which is formed on the end of the development cartridge case side plate 151*d*.

The side seal 153 is formed of plural sponge members as shown in FIG. 4B. That is, the side seal 153 includes a main side seal 153*a*, an upper side seal 153*b*, a lower side seal 153*c*, an upper edge seal 153*d*, an anterior blade side seal 153*f*, and a posterior blade side seal 153*g*.

The main side seal 153*a* is adhered to the development cartridge case side plate 151*d* in a position corresponding to the hole 151*d*1 for attachment of the development roller 132. The main side seal 153*a* is disposed to oppose the end(s) of the development roller 132 so as to restrain the leakage of the toner from the end(s) of the development roller 132 in the sheet width direction (see FIGS. 1 to 3).

The upper side seal 153*b* is adhered to the development cartridge case side plate 151*d* in a position above the main side seal 153*a*. The upper side seal 153*b* is disposed to oppose the end(s) of the toner layer thickness control blade 135 so as to restrain the leakage of the toner from the end(s) of the toner layer thickness control blade 135 in the sheet width direction. A blade upper seal 154 is disposed so to be adjacent to the upper part of the upper side seal 153*b*. The blade upper seal 154 is adhered to the development cartridge case top plate 151*c*. Furthermore, the blade upper seal 154 is provided across the whole length of the toner layer thickness control blade 135 (plate spring part 135*a*) in the sheet width direction so as to restrain the leakage of the toner from a clearance between the upper end of the plate spring 135*a* of the toner layer thickness control blade 135 and the development cartridge case top plate 151*c*.

The lower side seal 153*c* is adhered to the upper surface of the toner layer forming part base plate 151*b*. The lower side seal 153*c* is disposed to be adjacent to the inside of the main side seal 153*a* in the sheet width direction so as to restrain the leakage of the toner from the inner end of the main side seal 153*a* in the sheet width direction.

The upper edge seal 153*d*, the anterior blade side seal 153*f*, and the posterior blade side seal 153*g* are structured and arranged so as to restrain the leakage of the toner from the end(s) of the sheet width direction of a contact part between the toner layer thickness control blade 135 and the development roller 132 (see FIGS. 1 to 3).

The upper edge seal 153*d* is adhered to the development cartridge case side plate 151*d*. This upper edge seal 153*d* is disposed to be in contact with the upper end of the main side seal 153*a*, the lower end of the upper side seal 153*b*, and the lower end of the posterior blade side seal 153*g*.

The anterior blade side seal 153*f* is adhered to the lower end of the anterior side (outer side) of the toner layer thickness control blade 135, and to both ends of the sheet width direction of the control blade 135. The posterior blade side seal 153*g* is adhered to the lower end of the posterior side (inner side) of the toner layer thickness control blade 135, and to both ends of the sheet width direction of the control blade 135.

A felt member 155 is provided to cover the side seal 153 (except for the lower side seal 153*c*) with the above-mentioned structure. The felt member 155 is made of fluorine based synthetic resin, and is structured and arranged such that the side seal 153 is pressed against both ends of the development roller 132 (see FIGS. 1 to 3) to ensure a seal condition, while restraining an increase in rotational torque of the development roller 132 due to the pressing.

The lower film 156 is a thin plate made of polyester. The lower film 156 is disposed on the upper surface of the toner layer forming part base plate 151*b*. A fixing part 156*a* which is a tip end of the lower film 156 (an upstream side end of the development roller rotational direction RD shown in FIG. 5) is adhered and fixed to the upper surface of the toner layer forming part base plate 151*b*. A clearance is formed between a movable part 156*b* which is a basic end of the lower film 156 (a downstream end in the development roller rotational direction RD), and the upper surface of the toner layer forming part base plate 151*b*. The lower side seal 153*c* is disposed on the end(s) of the clearance in the sheet width direction.

That is, as shown in FIG. 5, a lower film attachment surface 151*b*1 and a lower seal attachment surface 151*b*2 are formed on the upper surface of the toner layer forming part base plate 151*b*. The lower seal attachment surface 151*b*2 is disposed on the downstream side of the development roller rotational direction RD away from the lower film attachment surface 151*b*1, and is formed in such a recessed shape that accommodates therein the lower side seal 153*c*. A fixing part 156*a* of the lower film 156 is adhered to the lower film attachment surface 151*b*. Furthermore, the lower side seal 153*c* is adhered to the end(s) of the lower side seal attachment surface 151*b*2 in the sheet width direction.

Referring to FIGS. 4A, 4B and 5, the movable part 156*b* of the lower film 156 is structured and arranged to be pressed against the peripheral surface 132*a* of the development roller 132 so as to be deformed downward. The lower film 156 is configured to be capable of restraining the leakage of the toner from the clearance between the development roller 132 and the lower end of the development roller accommodating opening 151*e* by causing the peripheral surface 132*a* of the development roller 132 having passed through a development area 130*d*, in which area the peripheral surface 131*a* of the photoreceptor drum 131 is opposed to the peripheral surface 132*a* of the development roller 132, to be slid or sideswiped against the movable part 156*b*.

FIGS. 6 to 9 shows details of a mounted state of the side seal 153 or the like to the development cartridge case 151.

Figure 6A:
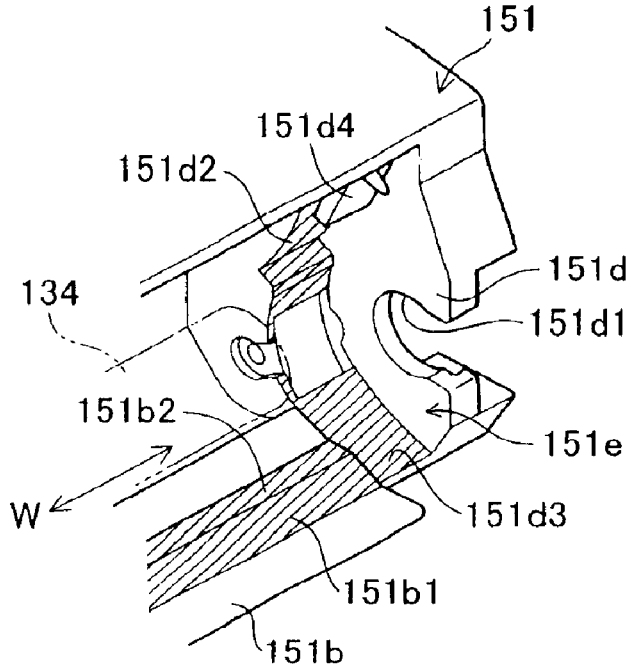
FIGS. 6A and 6B are diagrams showing details of a mounted state of a side seal or the like onto a development cartridge case.
Figure 6B:
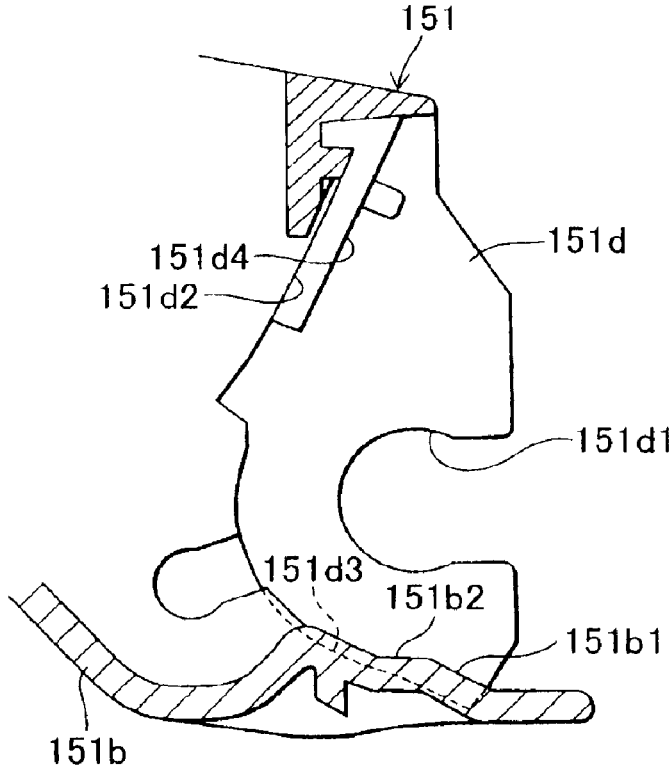

As shown in FIG. 6, the toner layer forming part base plate 151*b* is configured to have a width substantially equal to the entire width of the feed roller 134. The upper seal attachment surface 151*d*2, the lower seal attachment surface 151*d*3, and a blade attachment surface 151*d*4 are formed within the development cartridge case side plate 151*d* in the sheet width direction (in a direction indicated by an arrow W shown) away from the hole 151*d*1. The upper seal attachment surface 151*d*2 is formed above the feed roller 134. The lower seal attachment surface 151*d*3 is formed ahead of the lower end of the feed roller 134 (in an opened direction of the development roller accommodating opening 151*e*). The blade attachment surface 151*d*4 is formed to protrude forward at the upper end of the upper seal attachment surface 151*d*2, and at the end(s) of the sheet width direction.

Figure 7A:
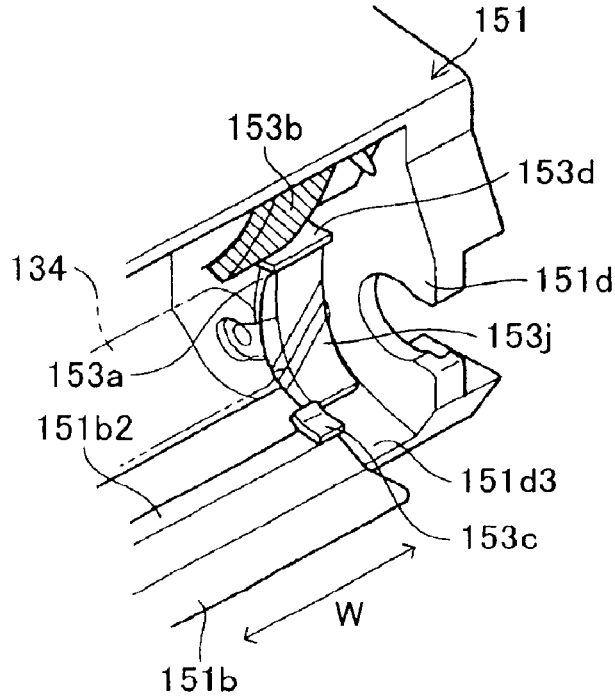
FIGS. 7A and 7B are diagrams showing details of a mounted state of a side seal or the like onto the development cartridge case.
Figure 7B:
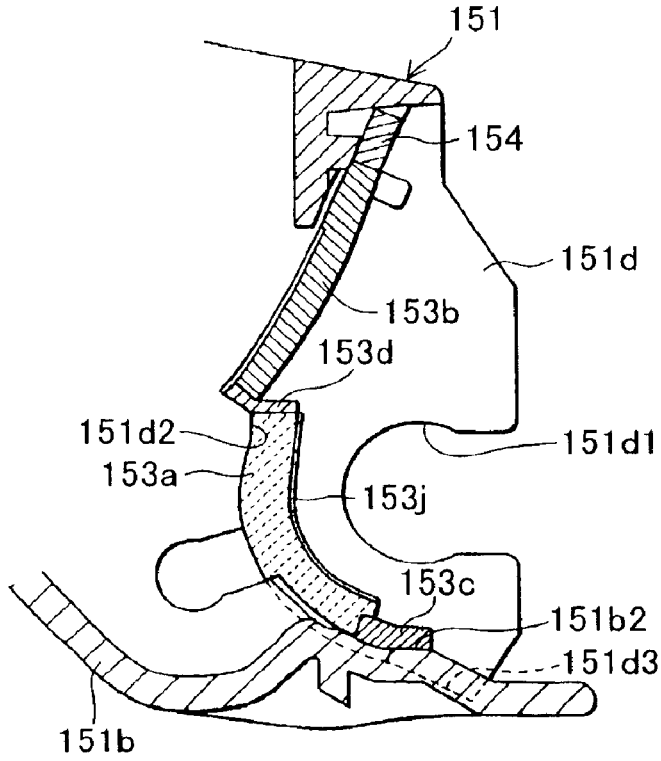

As shown in FIG. 7, the main side seal 153*a* is adhered to the upper seal attachment surface 151*d*2 and the lower seal attachment surface 151*d*3 so as to run between the upper seal attachment surface 151*d*2 and the lower seal attachment surface 151*d*3. The upper side seal 153*b* is adhered to the upper seal attachment surface 151*d*2. The upper edge seal 153*d* runs between an upper end of the main side seal 153*a* and a stepped part formed on the upper seal attachment surface 151*d*2 to correspond to the thickness of the upper side seal 153*b*, and is adhered to the above-mentioned stepped part.

The lower side seal 153*c* is adhered to the lower side seal attachment surface 151*b*2 to correspond to a contact part (a press contact part) between the end of the feed roller 134 in the sheet width direction and the development cartridge case side plate 151*d*. That is, the outer end of the lower side seal 153*c* in the sheet width direction comes into contact with the inside end of the main side seal 153*a* in the sheet width direction, thereby restraining the leakage of the toner from the contact part (press contact part) between the end of the feed roller 134 and the development cartridge case side plate 151*d*.

An intermediate film 153*j* is adhered to the surface of the main side seal 153*a* so as to improve adhesiveness to the felt member 155.

Figure 8A:
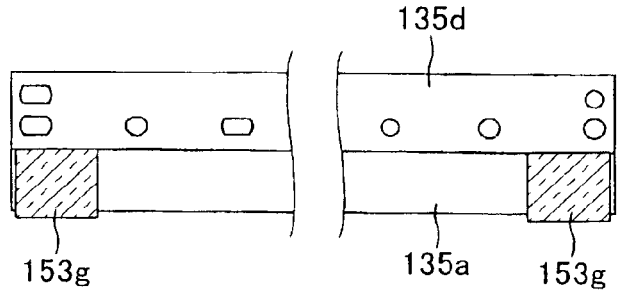
FIGS. 8A to 8C are diagrams showing details of a mounted state of a side seal or the like onto the development cartridge case.

As shown in FIG. 8A, a pair of posterior blade side seals 153*g* is adhered to the posterior side of the plate spring part 135*a* of the toner layer thickness control blade 135 (to the side where the butting part 135*b* is not formed). The pair of posterior blade side seals 153*g* is provided at both lower ends of the plate spring part 135*a* in the width direction. The plate sparing part 135*a* of the toner layer thickness control blade 135 is attached to the blade attachment surface 151*d*4 (see FIG. 6) via the plate spring holder 135*c* and the spacer 135*d* in such a manner that the lower end of the posterior blade side seal 153*g* is pressed against the main side seal 153*a* with the upper edge seal 153*d* sandwiched therebetween.

Figure 8B:
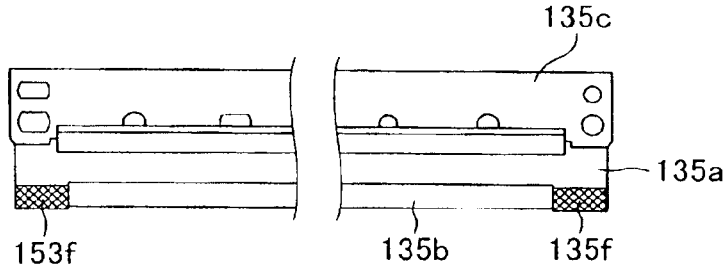
Figure 8C:
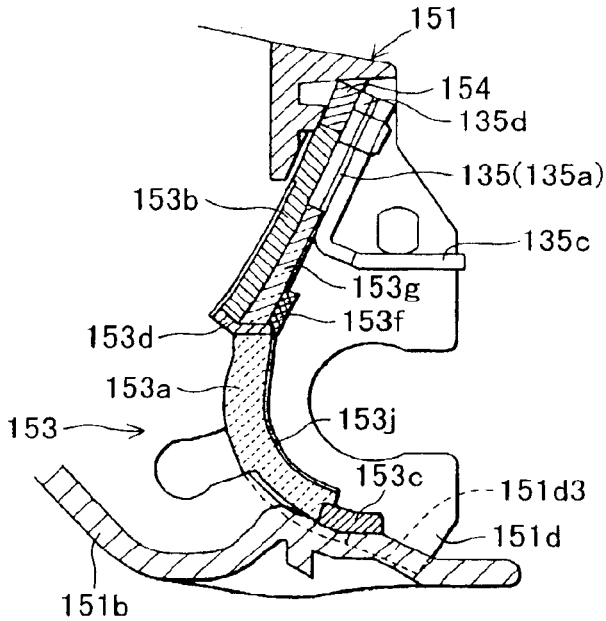

Furthermore, as shown in FIG. 8B, a pair of anterior blade side seals 153*f* is adhered to the anterior surface (one side where the butting part 135*b* is formed) of the plate spring part 135*a* of the toner layer thickness control blade 135. The pair of anterior blade side seals 153*f* is provided in a position on both lower ends in the width direction of the plate spring part 135*a*, where the butting part 135*b* is not formed.

In this way, the side seal 153 is formed.

Figure 9A:
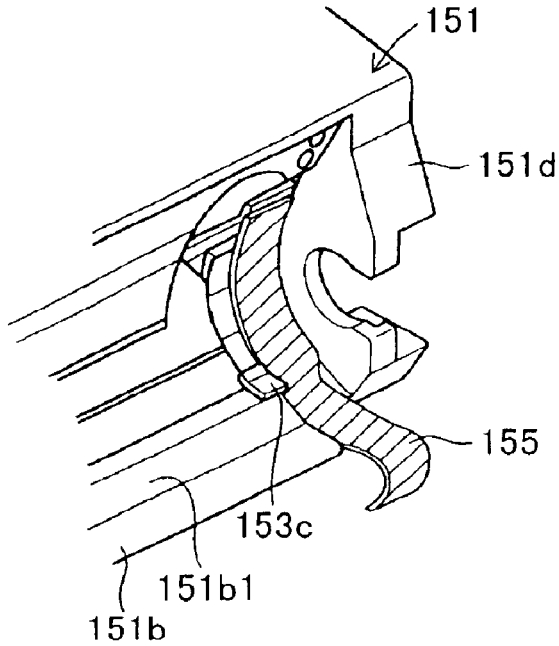
FIGS. 9A to 9B are diagrams showing details of a mounted state of a side seal or the like onto the development cartridge case.
Figure 9B:
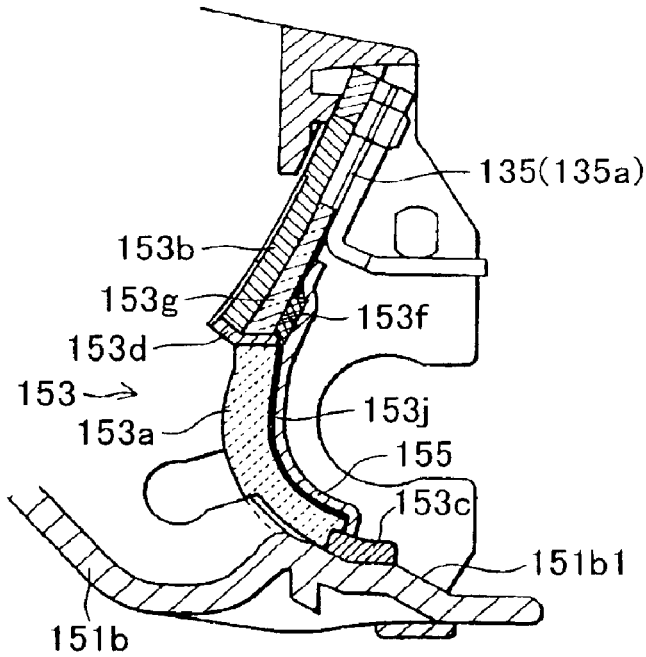

As shown in FIG. 9, the felt member 155 is provided to cover the surface of the plate spring part 135*a* of the toner layer thickness control blade 135, the anterior blade side seal 153*f*, the intermediate film 153*j*, and the lower seal attachment surface 151*d*3.

<Schematic Structure of Non-Magnetic One-Component Toner>

A non-magnetic one-component polymer toner of the embodiment (hereinafter simply referred to as a "toner") is composed of toner base particles, and an external additive. The toner base particles are composed of a binder resin (binder), a colorant, an exfoliation agent, and a charge control agent. The toner base particles can be made by, for example, a suspension polymerization method, or the like.

The toner base particles in the toner of the embodiment are formed in the form of powder particles having a substantially spherical shape. More specifically, in a particle size distribution of the toner base particles, the ratio of powder particles having a circle equivalent diameter of 3 to 20 μm and a circularity of 0.98 or more to the toner base particles is 60% or more based on the number of particles. This particle size (distribution) of the toner base particles can be set appropriately depending on a polymerization condition, a classification, and the like.

Furthermore, in the particle size distribution of the embodiment of the toner (toner base particles), the ratio of powder particles having a circle equivalent diameter of 3 μm or less to the base particles is 35% or less based on the number of particles.

Also, the particle size distribution of the embodiment of the toner (toner base particles) is set so as not to exhibit a peak of 6% or more based on the number of particles in the circle equivalent diameter of 3 μm or less.

The above-mentioned circle equivalent diameter and particle size distribution can be obtained using a flow particle image analyzer. This flow particle image analyzer is designed to take an image of each particle moving through a flow cell, and to process the image, thereby measuring the circle equivalent diameter and the circularity at the same time, as well as the particle size distribution based on the circle equivalent diameter. The term "circle equivalent diameter" set forth herein means a diameter of a sphere object having the same projected area as that of the particle. The term "circularity" set forth herein means a value obtained by dividing a peripheral length of a circle having the same area as the particle area by a particle perimeter. That is, when the particle perimeter is defined as PP, and the circle equivalent diameter is as CED, the circularity C is determined by the following equation:

$$C=\pi\times CED/PP.$$

Unlike the Coulter type particle analyzer well known in the art (in which the mark "Coulter" is a registered trademark) and a laser diffraction particle size analyzer, the above-mentioned flow particle image analyzer can measure the particle size distribution with high accuracy in a sample of toner powder particles both in a region of a toner average particle size of about 6 to 12 μm (toner average particle size area) and in a region of a fine particle size of about 3 μm to a submicron level. As such a flow particle image analyzer, for example, FPIA-1000 (manufactured by SYSMEX CORPORATION, in which the mark "FPIA" is a registered trademark) can be used.

In contrast, in the Coulter (registered trademark) type particle size distribution measuring device, a dynamic range of measurement is limited to a range of 2 to 60% of an aperture diameter. For example, for an aperture diameter of 50 μm, the dynamic range is from 1 to 30 μm, which ensures the measurement accuracy of the particles in the toner average particle size range, while resulting in a decrease of the measurement accuracy of the particles in the fine particle range. Additionally, for an aperture diameter of 20 μm, the dynamic range is from 0.4 to 12 μm, which can lead to clogging of the aperture with toner aggregates. Thus, the Coulter (registered trademark) type measuring device cannot measure the particle size distribution with high accuracy in the above-mentioned sample including both particles in the toner average particle size range and in the fine particle size range.

In the laser diffraction type particle size distribution measuring device, the measurement accuracy of the particles in the toner average particle size range is good, but the measurement accuracy of the particles in the fine particle range is degraded. This is because patterns of scattered lights are similar to each other in the small particle size range, such as in the fine particle size range (particularly, of about 1 μm or less), making it difficult to specify the particle size, leading to an increase in measurement error. Compared with the particles with the toner average particle size which is relatively large and an aggregate thereof, a volume ratio of the particles in the fine particle range to the base particles is very small. Thus, even if the particles in the fine particle range exist at a ratio of about 35% based on the number of particles, the number of fine particles counted tends to become smaller than the number of fine particles existing in the actual number distribution.

<<Binder Resin>>

The binder resin may be a synthetic resin constituting a main component of the toner (main part of toner base particles). The binder resin is heated and/or pressurized to be fixed onto the surface of a recording medium (paper, an OHP sheet, or the like).

The binder resins may includes various kinds of resins which are used in the prior art as the binder resin for toner without limitation. For example, suitable binder resins may include, but not limited to, styrene, such as polystyrene, poly-p-chlorostyrene or polyvinyl toluene, and monopolymer of its derivative; styrene-styrene derivative copolymer such as styrene-p-chlorostyrene copolymer, and styrene-vinyltoluene copolymer; styrene-based copolymer such as styrene-vinylnaphthalene copolymer, styrene-acrylic acid based copolymer, styrene-methacrylic acid based copolymer, styrene-α-chloromethacrylic acid methyl copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer and styrene-acrylonitrile-indene copolymer; and polyvinyl chloride, phenol resin, natural denatured phenol resin, natural resin denatured maleic resin, acrylic resin, methacrylic resin, polyvinyl acetate, silicone resin, polyester resin, polyurethane, polyamide resin, fran resin, epoxy resin, polyvinyl butyral, terpene resin, coumarone-indene resin, petroleum resin and the like. These resins may be used independently, or in combination.

In particular, the toner for full-color image formation requires the binder resin to be transparent, to be substantially colorless enough to avoid color disorder in a toner image, to have good compatibility with a charge control resin as the above-mentioned charge control agent, to have fluidity under appropriate heat or pressure, and to be capable of being subjected to microparticulation. Preferable binder resins include, for example, styrene resin, acrylic resin, styrene-acrylic based copolymer, polyester resin, or the like. Particularly, in manufacturing the toner base particles by the suspension polymerization method, it is most preferable that the styrene-acrylic based copolymer is used as the binder resin from a viewpoint of ease of suspension polymerization, and ease of control of a glass transition point of the binder resin.

<<Colorant>>

The colorant is dispersed or infiltrated into the binder resin so as to give a predetermined color to the toner. As the colorant, known dyes and pigments may be used independently or in combination.

Suitable colorants used in the toner for the full-color image formation include, for example, the following: an organic pigment such as quinophthalone yellow, Hansa yellow, isoindolinone yellow, benzidine yellow, perinone orange, perinone red, perinone maroon, Rhodamine 6G lake, quinacridone red, rose bengal, copper phthalocyanine blue, copper phthalocyanine green, and a diketopyrrolopyrrole based pigment; inorganic segments and metallic powders such as carbon black, titanium white, titanium yellow, ultramarine blue, cobalt blue, red oxide, aluminum powders and bronze; an oil-soluble dye and a disperse dye such as azo-based dye, quinophthalone-based dye, anthraquinone-based dye, xanthine-based dye, triphenylmethane-based dye, phthalocyanine-based dye, indophenol-based dye and indoaniline-based dye; a triarylmethane-based dye which is denatured by resin such as rosin, rosin denatured phenol and rosin denatured maleic acid; and a dye or a pigment processed with a higher fatty acid or a resin.

As the colorants in the toner for the mono-color image formation in a chromatic color, a pigment and a dye which are the same in color can be mixed appropriately to each other. Suitable combinations of pigments and dyes include, for example, rhodamine-based pigment and dye, quinophthalone-based pigment and dye, and phthalocyanine-based pigment and dye.

<<Exfoliation Agent>>

The exfoliation agent is added so as to have good fixation of the toner on the recording medium. This exfoliation agent exists in a mixed state with the binder resin, or in an attached state on the surface of the binder resin.

The exfoliation agents include various kinds of agents which are (may be) used in the prior art as the exfoliation agent for the toner. For example, suitable exfoliation agents include, but not limited to,: polyolefin wax such as low molecular weight polyethylene, low molecular weight polypropylene and low molecular weight polybutylene; plant's natural wax such as candelilla, carnauba, rice, haze wax and jojoba; petroleum wax such as paraffin, microcrystaline, petrolatum, and its denatured wax; synthetic wax such as Fischer Tropsch wax; and polyfunctional ester compound, such as pentaerythritol tetramyristate, pentaerythritol tetrapalmitate and dipentaerythritol hexapalmitate. These exfoliation agents may be used individually or in combination.

<<Electrostatic Charge Control Agent>>

The electrostatic charge control agent is an additive for stably charging the toner with a predetermined amount of charge (polarity and magnitude). Suitable electrostatic charge control agents include not only synthetic resin with a polar group (the charge control resin), but also nigrosine, triphenylmethane, quaternary ammonium salt, and the like.

<<External Additive>>

The external additive is an additive for adjusting the electrostatic charge, fluidity, and preservation stability of the toner, and is made up of submicron particles, the particle size of which is much smaller than that of the toner base particle. The external additive is attached on and/or embedded into the surfaces of the toner base particles and/or of the electrostatic charge control resin.

As the external additive, inorganic particles or synthetic resin particles may be used. Suitable inorganic particles for use include, for example, silica, aluminum oxide, titanium oxide, silicon-aluminum co-oxide, silicon-titanium co-oxide, and hydrophobized thereof. As the hydrophobization of the silica fine particles, a process of hydrophobization can be performed with a coupler, such as silicon oil, dichlorodimethyl silane, hexamethyidisilazane and tetramethyidisilazane. Suitable synthetic resin particles for use include, for example, methacrylic acid ester polymer particles, acrylic acid ester polymer particles, styrene-methacrylic acid copolymer particles, and core shell type particles in which the core is formed of styrene polymer, and the shell is formed of the metallic acid ester polymer.

An added amount of the external additive is not limited, but may normally be 0.1 parts by weight to 6 parts by weight with respect to 100 parts by weight of the toner base particles.

<Outline of Image Forming Operation by Laser Printer>

Now, the outline of an image forming operation by the laser printer 100 with the foregoing configuration will be described with reference to the accompanying drawings.

<<Sheet Feed Operation>>

First, referring to FIG. 1, a stack of sheets loaded on the sheet pushing plate 123 are urged upward to the sheet feed roller 171 by the sheet pushing plate 123. This brings the uppermost sheet from the stack loaded on the pushing plate 123 into contact with the peripheral surface of the feed roller 171. When the feed roller 171 is rotationally driven in a direction indicated by an arrow shown (counterclockwise), the tip end of the sheet moves to the upper right of FIG. 1 to be nipped between the feed roller 171 and the separation pad 125. Only the uppermost sheet is conveyed toward the paper dust removing roller 172 as the feed roller 171 rotates.

The sheet delivered to the paper dust removing roller 172 has paper dusts thereon removed by the removing roller 172, and thereafter is conveyed to a contact part (resist part) between the upper resist roller 139 and the lower resist roller 175, while being guided by the sheet guide 173 as well as the sheet guide 174 on the upstream side of the process. After the tip end of the sheet is butted against the resist part, the lower resist roller 175 starts to be rotationally driven at predetermined timing, causing the upper resist roller 139 to rotate following the rotation of the lower resist roller 175. This allows the sheet to be delivered toward the transfer position where the photoreceptor drum 131 is opposed to the transfer roller 137. In this way, sheet skew correction and sheet conveyance timing adjustment are performed.

<<Carrying of Toner Image on Peripheral Surface of Photoreceptor Drum>>

While the sheet is being conveyed toward the transfer position as mentioned above, an image is carried on the peripheral surface 131*a* of the photoreceptor drum 131 with the toner T as follows.

First, the peripheral surface 131*a* of the photoreceptor drum 131 is charged uniformly by the electrostatic charger 136. The peripheral surface 131*a* of the photoreceptor drum 131 charged by the electrostatic charger 136 rotates in the direction indicated by an arrow shown (clockwise) to face the laser irradiation opening 130*c*. Under the laser irradiation opening 130*c*, the peripheral surface 131*a* of the photoreceptor drum 131 uniformly charged as described above is scanned and irradiated with a laser beam in the sheet width direction by the scanner unit 160. The laser beam is generated based on image data as mentioned above. That is, a laser beam emission state (pulse shape of ON/OFF) is modulated according to the image data. The photoreceptor drum 131 has its peripheral surface 131*a* scanned with the thus modulated laser beam, so that an electrostatic latent image is formed on the peripheral surface 131*a*. The peripheral surface 131*a* of the drum 131 with the electrostatic latent image formed thereon rotates in the direction indicated by the arrow shown (clockwise) to be brought into contact with or to approach the peripheral surface of the development roller 132. The charged toner T is carried substantially uniformly on the peripheral surface of the development roller 132 as follows.

Referring to FIG. 2, the rotation of the feed roller 134 in the direction indicated by the arrow shown (counterclockwise) allows the toner T to be transferred or attached to the peripheral surface 132*a* of the development roller 132. The thus-obtained peripheral surface 132*a* of the development roller 132 to which the toner T is transferred by the feed roller 134 rotates in the direction indicated by the arrow shown (counterclockwise) to reach the contact position with the toner layer thickness control blade 135. The toner layer thickness control blade 135 can adjust the amount of attachment of the toner T on the peripheral surface 132*a* and the amount of charge thereof. Thus, the peripheral surface 132*a* on which the amounts of attachment and of charge of the toner T are adjusted rotates in the direction indicated by the arrow shown (counterclockwise) to reach the position opposed to the photoreceptor drum 131.

Referring to FIG. 5, the peripheral surface 131*a* of the photoreceptor drum 131 with the electrostatic latent image formed thereon comes into contact with or close to the peripheral surface 132*a* of the development roller 132 with the charged toner T carried thereon at the development area 130*d*. This allows the toner T to be transferred to the peripheral surface 131*a* in a pattern corresponding to the electrostatic latent image formed on the peripheral surface 131*a* of the photoreceptor drum 131. That is, the electrostatic latent image formed on the peripheral surface 131*a* of the photoreceptor drum 131 is developed with the toner T, and the toner image is carried on the peripheral surface 131*a*. The peripheral surface 132*a* of the development roller 132 fed into the development area 130*d* is slid (sideswiped) against the movable part 156*b* of the lower film 156 by the rotation of the development roller 132 in the direction indicated by the arrow (RD), and then slid (sideswiped) against the feed roller 134 (see FIG. 2) to receive the supply of the toner again.

Referring to FIGS. 4 and 5, in the development operation by the rotation of the development roller 132 or the like, both ends of the peripheral surface 132*a* of the development roller 132 in the sheet width direction is pressed and slid (sideswiped) against the felt members 155 urged by the side seals 153. Thus, the side seals 153 can restrain the leakage of the toner from the development roller accommodating opening 151*e* of the development cartridge case 151 in the vicinity of both ends of the development roller 132.

The lower side seal 153*c* and the lower film 156 are disposed in a clearance between the lower end of the development roller 132 and the upper surface of the toner layer forming part base plate 151*b*. In the development operation by rotation of the development roller 132 or the like, the peripheral surface 132*a* of the development roller 132 rotates in the direction indicated by the arrow shown (RD), while being pressed and slid (sideswiped) against the movable part 156*b* of the lower film 156 urged by the lower side seal 153*c*. This restrains the leakage of the toner from the inside of the lower part of the side seal 153 in the sheet width direction, and from the clearance between the lower end of the development roller 132 and the upper surface of the toner layer forming part base plate 151*b*.

At this time, the toner of the embodiment is restrained from being fusion bonded to the surface of the movable part 156*b* when the peripheral surface 132*a* of the development roller 132 is pressed and slid (sideswiped) against the movable part 156*b* of the lower film 156 urged by the lower side seal 153*c*.

<<Transfer of Toner Image from Peripheral Surface of Photoreceptor Drum to Paper Sheet>>

Referring back to FIG. 1, the image of the toner T carried on the peripheral surface 131*a* of the photoreceptor drum 131 as mentioned above is conveyed toward the above-mentioned transfer position by rotation of the peripheral surface 131*a* in the direction indicated by the arrow shown (clockwise). In this transfer position, the image of the toner T is transferred from the peripheral surface 131*a* of the photoreceptor drum 131 to the paper sheet.

The peripheral surface 131*a* of the photoreceptor drum 131 having passed through the above-mentioned transfer position rotates in the direction indicated by the arrow shown (clockwise) to reach the drum cleaner 138. The drum cleaner 138 removes the residual toner T on the peripheral surface 131*a*, and foreign matter, such as dust, attached to the peripheral surface 131*a*. The peripheral surface 131*a* thus cleaned can be repeatedly used for the image formation, which involves uniformly charging the peripheral surface by the electrostatic charger 136.

<<Fixing and Ejection of Sheet>>

The sheet with the toner T image transferred thereto is sent to the fixing unit 180 along the sheet conveyance path PP, and then nipped between the heat roller 182 and the pressure roller 183 thereby to be pressed and heated. Thus, the image of the toner T is fixed onto the surface of the sheet. Thereafter, the sheet is sent to the sheet ejection port 111*c* via the sheet ejector 190, and ejected onto the catch tray 111*b* via the sheet ejection port 111*c*.

EXAMPLES

Examples of the toners of the embodiments will be described below in comparison with comparative examples.

Table 1 shows that in Examples and Comparative Examples, the ratio of fine particles of the toners in the fine particle range with a particle size (circle equivalent diameter) of 3 μm or less to the toner base particles (%); the ratio of particles having a circularity of 0.98 or more to the toner base particles (%) (both ratios being based on the number of particles); and the presence or absence of occurrence of fusion bonding of the toner to the lower film (the lower film 156 of FIG. 5) until ten thousands sheets have passed therethrough in the continuous printing tests. These continuous printing tests of the ten thousands sheets were carried out under the following condition. As the laser printer, a laser printer manufactured by Brother Industries, Ltd., (trade name: HL-1850) was used. The toner of about 200 g was filled into a toner cartridge of the laser printer. Thereafter, a text pattern corresponding to a print area of 1% was formed intermittently on a plain paper of a letter size (trade name: XEROX 4200) at intervals of 17 seconds.

In a column "fusion bonding" of Table 1, a mark O indicates that the fusion bonding was not caused in the lower film after printing of ten thousands sheets, while a mark X indicates that the fusion bonding was caused until ten thousands sheets have been printed, with the substantial number of sheets at the time of the fusion bonding being described next to the mark X. Furthermore, FIG. 10 indicates the toner particle size distribution in each of Examples and Comparative Examples. It should be noted that the particle size, circularity, and particle size distribution in Table 1 and FIG. 10 were obtained by measurement using the flow particle image analyzer FPIA-1000 (manufactured by SYSMEX CORPORATION, in which the mark "FPIA" is a registered trademark).

TABLE 1

| | 3 μm or less (%) | Circularity of 0.98 or more (%) | Fusion bonding |
|---|---|---|---|
| Example 1 | 3.20 | 87.0 | ○ |
| Example 2 | 5.06 | 65.6 | ○ |
| Example 3 | 5.26 | 72.3 | ○ |
| Example 4 | 18.7 | 77.6 | ○ |
| Example 5 | 20.3 | 79.8 | ○ |
| Example 6 | 25.3 | 79.5 | ○ |
| Example 7 | 32.4 | 84.9 | ○ |
| Comparative Example 1 | 37.0 | 84.3 | × 9000 sheets |
| Comparative Example 2 | 55.3 | 85.9 | × 7000 sheets |
| Comparative Example 3 | 55.5 | 79.4 | × 9000 sheets |
| Comparative Example 4 | 63.7 | 88.5 | × 5000 sheets |
| Comparative Example 5 | 63.8 | 89.9 | × 5000 sheets |

Table 1 shows clearly that in Examples 1 to 7 where the ratio of the fine particles to the toner base particles is 35% or less, the fusion bonding of the toner to the lower film was not caused before printing of ten thousands sheets. In contrast, in all of Comparative Examples 1 to 5 where the ratio of the fine particles to the toner base particles exceeds 35%, the fusion bonding of the toner to the lower film was caused until ten thousands sheets have been printed. The larger the ratio of the fine particles is, the earlier the fusion bonding tends to be caused.

Figure 10:
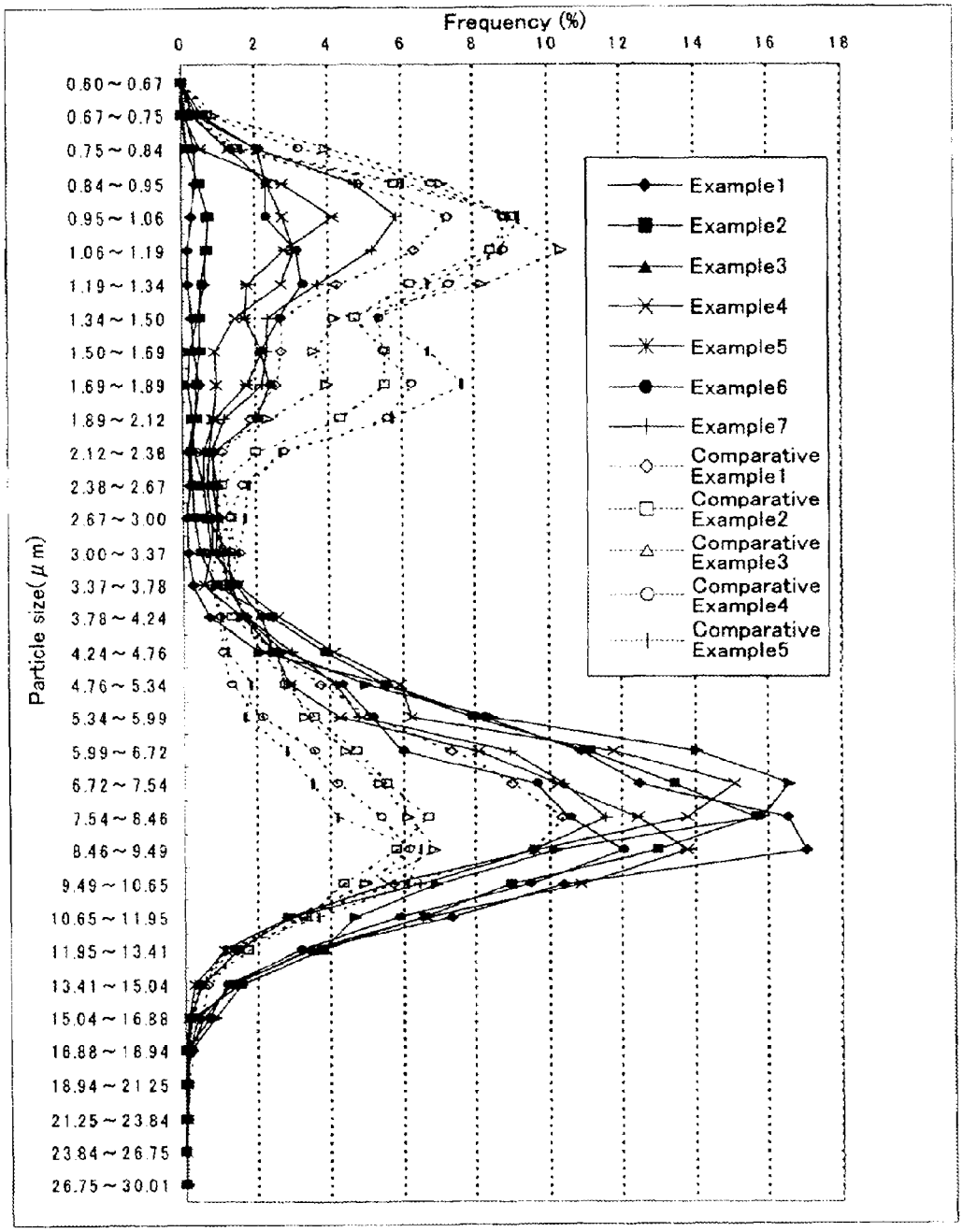
FIG. 10 shows various examples and comparative examples in accordance with one or more embodiments of the present invention.

FIG. 10 shows clearly that in Examples 1 to 7 where the fusion bonding of the toner to the lower film before printing ten thousands sheets was not caused, the toner particle size distribution of the particles with the circle equivalent diameter of 3 μm or less does not take a peak of 6% or more based on the number of particles.

<Suggestion of Modified Examples>

It should be noted that the above-mentioned embodiments and examples are illustrative embodiments and examples of the present invention that were simply considered best by the inventors at the filing date of the application. The present invention is not limited to the embodiments and examples described above. It is therefore apparent to those skilled in the art that various modifications can be made to the above-mentioned embodiments and examples without departing from the spirit and essential characteristics of the present invention. The restrictive consideration of the present invention based on the description of the above-mentioned embodiments and examples would unjustly harm the advantages of the present invention, while giving benefits to copycats.

Among elements constituting the means for solving the problems of the present invention, each element described in terms of operation and function includes not only the exemplary structures disclosed in the above embodiments and examples, but also any structure that can implement the operation and function as described above.

What is claimed is:

1. A developer supply device configured to be capable of supplying a developer to an image forming portion for forming an image with the developer by transferring the developer comprised of powder particles to a surface of an image carrier in a form of arrangement of the image, while moving the surface of the image carrier in a direction of conveyance, the developer supply device comprising:

a developer container configured to be capable of accommodating therein the developer, the developer container having an opening which is formed to have a longitudinal direction defined by a width direction perpendicular to the conveyance direction;

a developer carrier adapted to have a longitudinal direction defined by the width direction, and configured to be capable of carrying the developer on a peripheral surface thereof, the developer carrier being supported by the developer container so as to rotate at the opening in a predetermined rotational direction around an axis parallel to the width direction, thereby supplying the developer to the image forming portion; and a developer leakage restrainer constructed of a thin plate, wherein the leakage restrainer is attached to the developer container and arranged at the opening so as to be butted against the peripheral surface of the developer carrier at a downstream side of the rotational direction away from the image forming portion over the entire longitudinal direction of the developer carrier, wherein the developer is comprised of toner having a substantially spherical shape, in which, when a circle equivalent diameter means a diameter of a sphere object having the same projected area as that of the powder particle, a ratio of the powder particles having the circle equivalent diameter of 3 to 20 μm and a circularity of 0.98 or more to the entire powder particles of the developer is 60% or more based on the number of the particles, and a ratio of the powder particles having a circle equivalent diameter of 3 μm or less to the entire particles is 35% or less based on the number of particles.

2. The developer supply device according to claim 1, wherein the developer has particle size distribution that does not exhibit a peak of 6% or more based on the number of particles in the circle equivalent diameter of 3 μm or less.

3. The developer supply device according to claim 2, wherein the circle equivalent diameter of the powder particles is determined by a flow particle image analyzer.

4. The developer supply device according to claim 3, wherein the developer is manufactured by a polymerization method.

5. The developer supply device according to claim 4, wherein the developer is a non-magnetic one-component toner.

6. The developer supply device according to claim 5, wherein the developer leakage restrainer is made of polyester resin.

7. The developer supply device according to claim 6, wherein the developer is stored in an amount enough to be capable of forming the images on ten thousand sheets or more when forming the image at a reflected density of 1.0 or more at an area which occupies 1% of an area of an A4 size sheet, a letter size sheet, or a legal size sheet.

8. A developer supply device configured to be capable of supplying a developer to an image forming portion for forming an image with the developer by transferring the developer comprised of powder particles to a surface of an image carrier in a form of arrangement of the image, while moving the surface of the image carrier in a direction of conveyance, the developer supply device comprising:

a developer container configured to be capable of accommodating therein the developer, the developer container having an opening which is formed to have a longitudinal direction defined by a width direction perpendicular to the conveyance direction;

a developer carrier adapted to have a longitudinal direction defined by the width direction, and configured to be capable of carrying the developer on a peripheral surface thereof, the developer carrier being supported by the developer container so as to rotate at the opening in a predetermined rotational direction around an axis parallel to the width direction, thereby supplying the developer to the image forming portion; and a developer leakage restrainer constructed of a thin plate, wherein the leakage restrainer is attached to the developer container and arranged at the opening so as to be butted against the peripheral surface of the developer carrier at a downstream side of the rotational direction away from the image forming portion over the entire longitudinal direction of the developer carrier, wherein the developer is comprised of toner, in which, when a circle equivalent diameter means a diameter of a sphere object having the same projected area as that of the powder particle, a ratio of the powder particles having a circle equivalent diameter of 3 μm or less to the entire particles is 35% or less based on the number of particles.

9. The developer supply device according to claim 8, wherein the developer has particle size distribution that does not exhibit a peak of 6% or more based on the number of particles in the circle equivalent diameter of 3 μm or less.

10. The developer supply device according to claim 9, wherein the circle equivalent diameter of the powder particles is determined by a flow particle image analyzer.

11. The developer supply device according to claim 10, wherein the developer is a non-magnetic one-component toner.

12. The developer supply device according to claim 11, wherein the developer leakage restrainer is made of polyester resin.

13. The developer supply device according to claim 12, wherein the developer is stored in an amount enough to be capable of forming the images on ten thousand sheets or more when forming the image at a reflected density of 1.0 or more at an area which occupies 1% of an area of an A4 size sheet, a letter size sheet, or a legal size sheet.

14. A developer comprised of powder particles and configured to be used for a developer supply device comprised of a developer container having an opening which is formed to have a longitudinal direction defined by a width direction perpendicular to a conveyance direction of an image carrier, a developer carrier adapted to have a longitudinal direction defined by the width direction and supported by the developer container so as to rotate at the opening in a predetermined rotational direction around an axis parallel to the width direction, and a developer leakage restrainer constructed of a thin plate, wherein the leakage restrainer is attached to the developer container and arranged at the opening so as to be butted against the peripheral surface of the developer carrier at a downstream side of the rotational direction away from the image forming portion over the entire longitudinal direction of the developer carrier, wherein the developer is comprised of toner having a substantially spherical shape, in which, when a circle equivalent diameter means a diameter of a sphere object having the same projected area as that of the powder particle, a ratio of the powder particles having the circle equivalent diameter of 3 to 20 μm and a circularity of 0.98 or more to the entire powder particles of the developer is 60% or more based on the number of the particles, and a ratio of the powder particles having a circle equivalent diameter of 3 μm or less to the entire particles is 35% or less based on the number of particles.

15. The developer according to claim 14, wherein the developer has particle size distribution that does not exhibit a peak of 6% or more based on the number of particles in the circle equivalent diameter of 3 μm or less.

16. The developer according to claim 15, wherein the circle equivalent diameter of the powder particles is determined by a flow particle image analyzer.

17. The developer according to claim 16, wherein the developer is manufactured by a polymerization method.

18. The developer according to claim 17, wherein the developer is a non-magnetic one-component toner.

19. The developer according to claim 18, wherein the developer is stored in an amount enough to be capable of forming the images on ten thousand sheets or more when forming the image at a reflected density of 1.0 or more at an area which occupies 1% of an area of an A4 size sheet, a letter size sheet, or a legal size sheet.

* * * * *